US008936331B2

(12) United States Patent
Coxon

(10) Patent No.: US 8,936,331 B2
(45) Date of Patent: Jan. 20, 2015

(54) HINGE FOR AN APPLIANCE

(75) Inventor: David John Coxon, Louisville, KY (US)

(73) Assignee: General Electric Company, Schenectady, NY (US)

( * ) Notice: Subject to any disclaimer, the term of this patent is extended or adjusted under 35 U.S.C. 154(b) by 241 days.

(21) Appl. No.: 13/400,972

(22) Filed: Feb. 21, 2012

(65) Prior Publication Data

US 2013/0214660 A1 Aug. 22, 2013

(51) Int. Cl.
*A47L 19/02* (2006.01)
*A47B 49/00* (2006.01)

(52) U.S. Cl.
USPC ..... 312/326; 312/228

(58) Field of Classification Search
USPC ..... 312/228, 326–329; 16/380
See application file for complete search history.

(56) References Cited

U.S. PATENT DOCUMENTS

| | | | | |
|---|---|---|---|---|
| 2,071,085 | A * | 2/1937 | North | 49/386 |
| 2,309,001 | A * | 1/1943 | Nave et al. | 49/398 |
| 3,378,880 | A * | 4/1968 | Haldopoulos et al. | 16/337 |
| 3,883,201 | A * | 5/1975 | Busoni | 49/167 |
| 2006/0101873 | A1 * | 5/2006 | Kim et al. | 68/196 |
| 2009/0064534 | A1 * | 3/2009 | LeClerc | 34/603 |
| 2009/0064725 | A1 | 3/2009 | Lim et al. | |
| 2011/0156563 | A1 * | 6/2011 | Hamada et al. | 312/326 |

* cited by examiner

*Primary Examiner* — Darnell Jayne
*Assistant Examiner* — Timothy M Ayres
(74) *Attorney, Agent, or Firm* — Dority & Manning, P.A.

(57) ABSTRACT

The present subject matter provides a hinge for an appliance. The hinge is rotatably mounted to a cabinet of the appliance. The hinge includes a foot configured for receipt by a door of the appliance. Specifically, the foot has a tip that is configured for receipt into a cavity of the door and a substantially planar portion configured to be positioned adjacent a pocket of the door.

17 Claims, 4 Drawing Sheets

HINGE FOR AN APPLIANCE

FIELD OF THE INVENTION

The present subject matter relates generally to hinges for appliances, e.g., washing machine appliances.

BACKGROUND OF THE INVENTION

Front loading washing machines have a door mounted to a front panel of the appliance. The door permits access to the wash chamber of the appliance for loading and removal of articles in the wash chamber. In front loading washing machines, the door is mounted to the cabinet with a hinge. The hinge permits the door to rotate open and closed.

During assembly of front loading washing machine appliances, workers can mount a door to the appliance's cabinet with a hinge. To mount the door to the cabinet, a mounting fixture (e.g., a bracket) can hold the door in place while a worker secures the door to the cabinet. However, this method can increase the overall cost of producing washing machine appliances, e.g., by requiring production and/or purchase of the bracket to mount the door to the cabinet. Also, securing the door in the bracket can consume time.

In addition, a hinge can be secured to a washing machine appliance using a fastener that extends through the hinge and a door of the appliance. However, the fastener can be required to bear significant stresses during use of the door. Because the fastener alone secures the hinge to the appliance, the door may problematically separate from the appliance if the fastener fails.

Also, a washing machine appliance's door can include components constructed of plastic. During use of such doors, large stresses may arise within the door. For example, at the point where the door attaches to a hinge. Large stresses can deform the door's plastic components. Deformation of such components is generally undesirable.

Accordingly, a hinge that allows a worker to install an appliance's door to an appliance's cabinet without a mounting fixture would be useful. A hinge with features for assisting a fastener in securing the door to the hinge would also be useful. A hinge with features for limiting deformation or reducing stress in the door would also be useful.

BRIEF DESCRIPTION OF THE INVENTION

Aspects and advantages of the invention will be set forth in part in the following description, or may be obvious from the description, or may be learned through practice of the invention.

In a first embodiment, an appliance is provided. The appliance includes a cabinet having a front panel. A drum is rotatably mounted within the cabinet. The drum defines a chamber for receipt of articles. A door is configured for permitting selective access to the chamber of the drum. The door defines a pocket and also defines a cavity positioned adjacent the pocket of the door. A hinge assembly rotatably mounts the door to the front panel of the cabinet. The hinge assembly is configured for rotation about an axis. The hinge assembly includes an extension portion extending between a first end and a second end. The first end of the extension portion is positioned adjacent the axis. The hinge assembly also includes an arcuate portion having a proximal end and a distal end. The proximal end of the arcuate portion is positioned adjacent the second end of the extension portion. A foot is positioned adjacent the distal end of the arcuate portion. The foot has a substantially planar segment extending between the arcuate portion and a tip of the foot. The tip of the foot is disposed at least partially within the cavity of the door. The substantially planar segment of the foot is positioned adjacent the pocket of the door. A fastener is configured for selectively securing the door to the hinge.

In a second embodiment, an appliance is provided. The appliance includes a cabinet having a front panel. A drum is rotatably mounted within the cabinet. The drum defines a chamber for receipt of articles. A door is configured for permitting selective access to the chamber of the drum. The door defines a pair of pockets and also defines a pair of cavities. Each of the pair of cavities is positioned adjacent a respective one of the pair of pockets. A pair of hinges rotatably mounts the door to the front panel of the cabinet. The pair of hinges is configured for rotation about an axis. Each of the pair of hinges includes an extension portion extending between a first end and a second end. The first end of the extension portion is positioned adjacent the axis. An arcuate portion has a proximal end and a distal end. The proximal end of the arcuate portion is positioned adjacent the second end of the extension portion. A foot is positioned adjacent the distal end of the arcuate portion. The foot has a substantially planar segment extending between the arcuate portion and a tip of the foot. The tip of the foot is disposed at least partially within a respective one of the pair of cavities of the door. The substantially planar segment of the foot is positioned adjacent a respective one of the pockets of the door. A pair of fasteners is configured for cooperating with the pair of hinges in order to selectively secure the door to the hinge.

In a third embodiment, a hinge is provided. The hinge includes an elongated member extending from a first end to a second end. The elongated member is configured for rotating about an axis when the elongated member is mounted to an appliance. A pair of hinges is positioned adjacent the first end of the elongated member and the second end of the elongated member respectively. Each of the pair of hinges includes an extension portion extending radially from the elongated member. An arcuate portion has a proximal end and a distal end. The proximal end of the arcuate portion is positioned adjacent the extension portion. A foot is positioned adjacent the distal end of the arcuate portion. The foot has a substantially planar segment extending between the arcuate portion and a tip of the foot. The tip of the foot is configured for mating receipt by a door of the appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
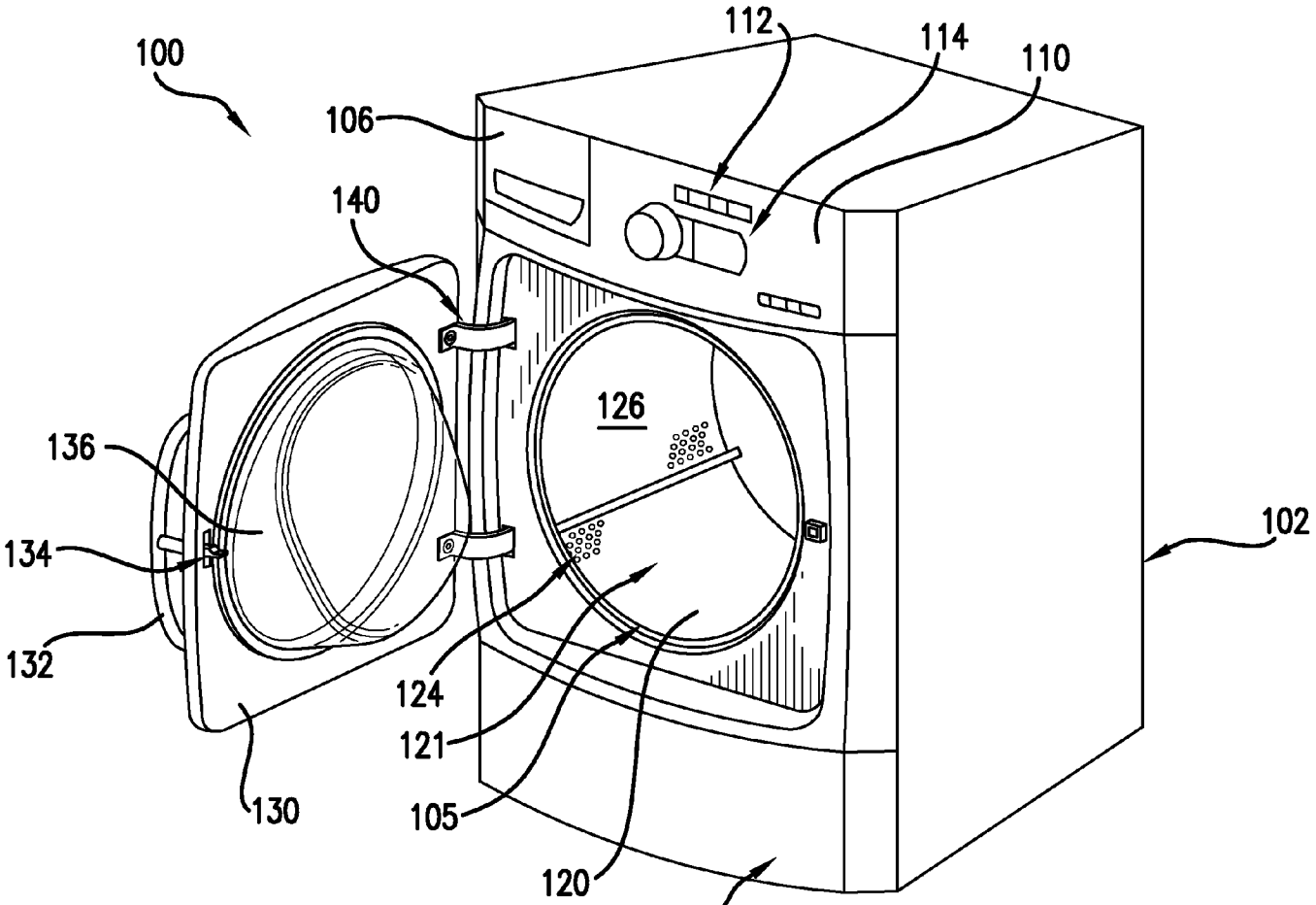
FIG. 1 provides perspective view of a washing machine appliance according to an exemplary embodiment of the present subject matter, a hinge rotatably mounts a door of the appliance to a cabinet of the appliance.

The present subject matter provides a hinge for an appliance. The hinge is rotatably mounted to a cabinet of the appliance. The hinge includes a foot configured for receipt by a door of the appliance. Specifically, the foot has a tip that configured for receipt into a cavity of the door and a substantially planar portion configured to be positioned adjacent a pocket of the door. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary horizontal axis washing machine appliance 100. However, while described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well. In addition, the teachings disclosed herein may be used with other appliances as well, e.g., a dryer appliance.

Wash machine appliance 100 has a cabinet 102 with a drum 120 rotatably mounted therein. A motor (not shown) is in mechanical communication with drum 120 in order to selectively rotate drum 120 (e.g., during an agitation or a rinse cycle of washing machine appliance 100). Drum 120 defines a wash chamber 121 that is configured for receipt of articles for washing. Ribs 126 extend from drum 120 into wash chamber 121. Ribs 126 assist agitation of articles disposed within wash chamber 121 during operation of washing machine appliance 100. For example, ribs 126 may lift articles disposed in drum 120 during rotation of drum 120. Drum 120 also defines a plurality of holes 124. Holes 124 are configured to permit a flow of wash fluid between an interior of drum 120 and an exterior of drum 120.

Cabinet 102 of washing machine appliance 100 has a front panel 104. A detergent drawer 106 is slidably mounted within front panel 104. Detergent drawer receives detergent and directs said detergent to wash chamber 121 during operation of appliance 100. Front panel 104 defines an opening 105 that permits user access to wash chamber 121 of drum 120. A door 130 is mounted to front panel 104 with a hinge assembly 140. A window 136 in door 130 permits viewing of wash chamber 121 during operation of appliance 100. Door 130 also includes a handle 132 that, e.g., a user may pull when opening and closing door 130. Latch 134 is configured for selectively securing door 130 in a closed configuration (i.e., a configuration in which door 130 is positioned adjacent front panel 106).

Front panel 104 also includes a control panel 110 with a plurality of input selectors 112. Control panel 110 and input selectors 112 collectively form a user interface input for operator selection of machine cycles and features. A display 114 of control panel 110 indicates selected features, a countdown timer, and/or other items of interest to appliance users.

Operation of washing machine appliance 100 is controlled by a controller or processing device (not shown), that is operatively coupled to control panel 110 for user manipulation to select washing machine cycles and features. In response to user manipulation of control panel 110, the controller operates the various components of washing machine appliance 100 to execute selected machine cycles and features.

In an illustrative embodiment, laundry items are loaded into wash chamber 121, and washing operation is initiated through operator manipulation of input selectors 112. Drum 120 is filled with water and detergent to form a wash fluid. One or more valves (not shown) can be controlled by washing machine appliance 100 to provide for filling drum 120 to the appropriate level for the amount of articles being washed. Once drum 120 is properly filled with fluid, the contents of wash chamber 121 are agitated with ribs 126 for cleansing of laundry items in drum 120.

After the agitation phase of the wash cycle is completed, drum 120 is drained. Laundry articles can then be rinsed by again adding fluid to drum 120, depending on the particulars of the cleaning cycle selected by a user, ribs 126 may again provide agitation within wash chamber 121. One or more spin cycles may also be used. In particular, a spin cycle may be applied after the wash cycle and/or after the rinse cycle in order to wring wash fluid from the articles being washed. During a spin cycle, drum 120 is rotated at relatively high speeds.

Figure 2:
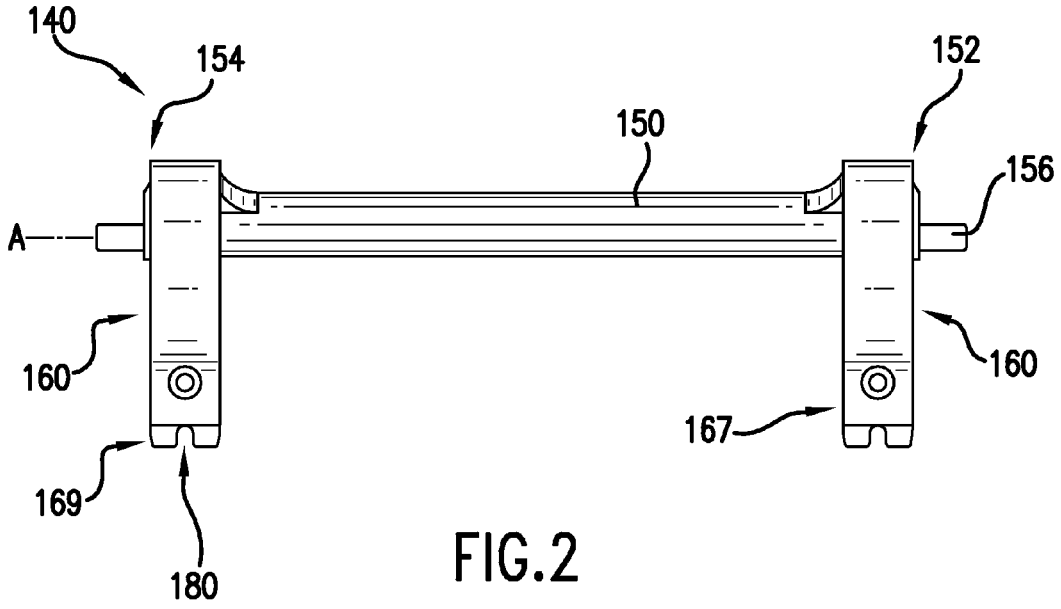
FIG. 2 provides a side view of a hinge assembly according to an exemplary embodiment of the present subject matter and as could be used in the washing machine appliance of FIG. 1.
Figure 3:
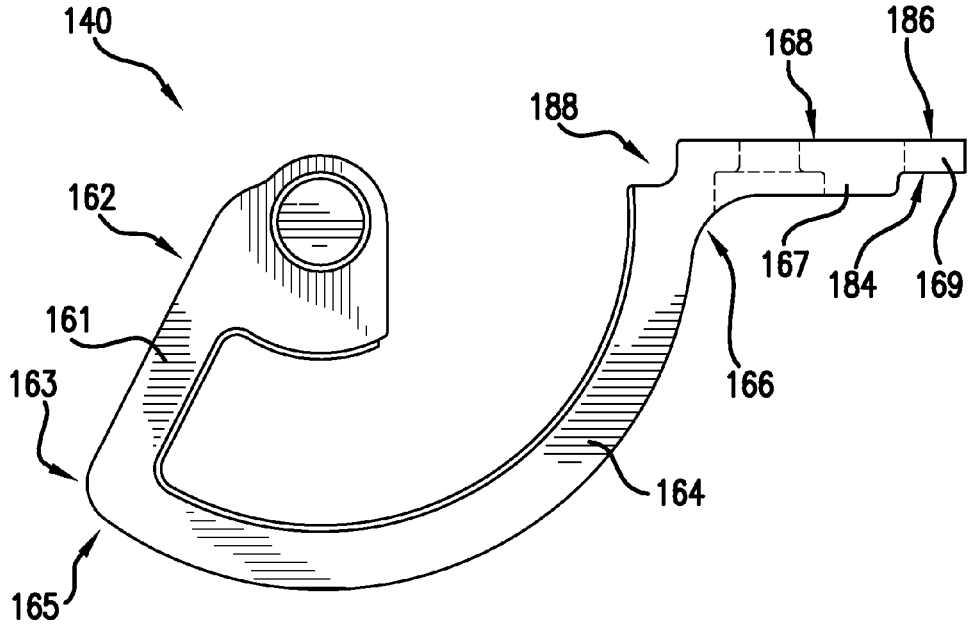
FIG. 3 illustrates a top view of the hinge assembly of FIG. 2.

FIGS. 2 and 3 illustrate hinge assembly 140 of washing machine appliance 100 (shown in FIG. 1). Hinge assembly 140 includes a pair of hinge arms 160 configured for rotation about an axis A. Hinge arms 160 are spaced apart by an elongated member 150. Elongated member 150 extends between a first end 152 and a second end 154. A respective one of hinge arms 160 is positioned adjacent first and second ends 152,154 of elongated member 150. Elongated member 150 connects hinge arms 160 such that rotation of one hinge arm 160 is transferred to the other hinge arm 160. It should be understood that in alternative embodiments, hinge assembly 140 need not include elongated member 150. Thus, in such alternative embodiments, hinge arms 160 may rotate independently of one another about axis A.

Each hinge arm 160 includes an extension portion 161 that extends between a first end 162 and a second end 163. First end 162 of extension portion 161 may be positioned adjacent elongated member 150 such that first end 162 is also positioned adjacent axis A. When hinge assembly 140 is installed, first end 162 of extension portion 161 may also be positioned adjacent front panel 104 of cabinet 104 (shown in FIG. 1). Extension portion 161 projects radially from elongated member 150 such that second end 163 of extension portion is positioned away from elongated member 150.

A proximal end 165 of an arcuate portion 164 is positioned adjacent second end 163 of extension portion 161. Arcuate portion 164 extends between proximal end 165 and a distal end 166. A foot 167 is positioned adjacent distal end 166 of arcuate portion 164. Foot 167 is configured for mating receipt by door 130 (shown in FIG. 1) in order to secure door 130 to hinge 140 and in turn cabinet 102 (shown in FIG. 1) as discussed in greater detail below. A substantially planar portion 168 of foot 167 extends between distal end 166 of arcuate portion 164 and a tip 169. Tip 169 also defines a notch 180. Further, foot 167 defines an inset 188 positioned adjacent distal end 166 of arcuate portion 164.

Posts 156 are positioned adjacent first and second ends 152,154 of elongated member 150. Posts 156 are configured for receipt into cabinet 102 (shown in FIG. 1). By receiving posts 156, hinge assembly 140 is rotatably mounted within cabinet 102. It should be understood that in alternative embodiments, hinge assembly 140 may be mounted to cabinet 102 in any suitable manner, e.g., holes defined by hinge arms 160 may receive a portion of cabinet 102 in order to allow hinge arms 160 to rotate about axis A.

Figure 4:
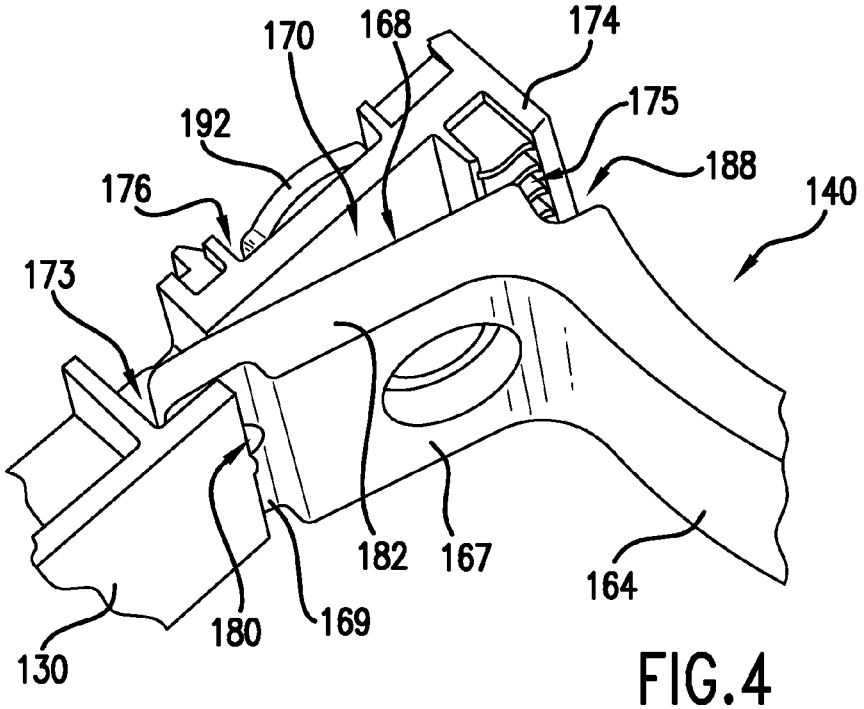
FIGS. 4 and 5 illustrate perspective views of a foot of the hinge of FIG. 2 being mounted to a door of the washing machine appliance of FIG. 1.
Figure 5:
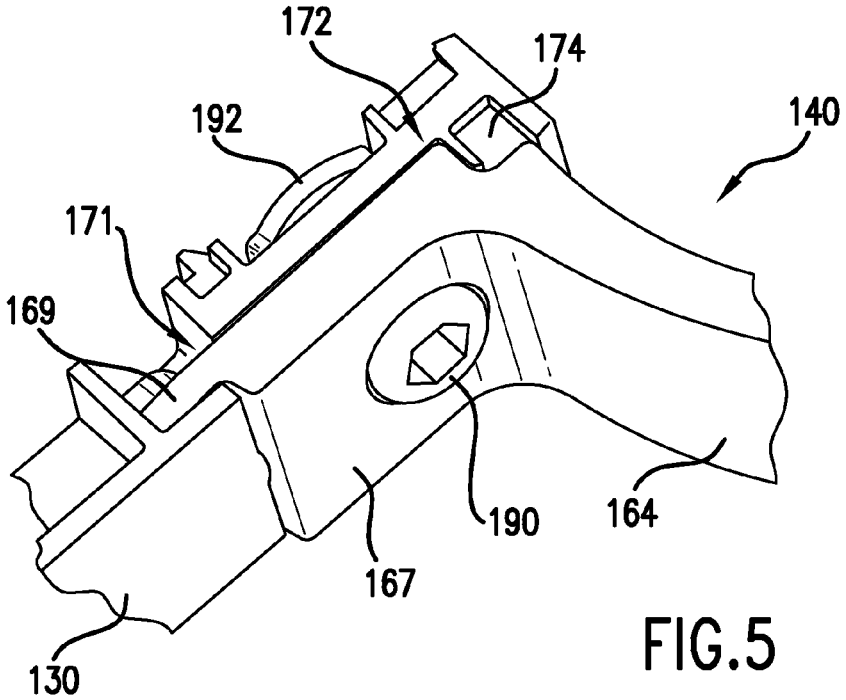

FIGS. 4 and 5 illustrate foot 167 of hinge assembly 140 being secured to door 130. As may be seen in FIG. 4, door 130 defines a pocket 170. A cavity 173 is also defined by door 130 and is positioned adjacent a first end 171 (FIG. 5) of pocket 170. A ledge 174 is also defined by door 130 and positioned adjacent a second end 172 (FIG. 5) of pocket 170. Ledge 174 includes a plurality of studs 175 configured for deformation during installation of hinge assembly 140 as discussed in more detail below. A slot 176 is also defined by door 130 such that at least a portion of door 130 is disposed between slot 176 and pocket 170.

In FIG. 4, tip 169 of foot 167 is positioned adjacent cavity 173 of door 130. When tip 169 is positioned adjacent cavity 173, notch 180 of foot 167 may receive a portion of door 130, e.g., to impede movement of door 130. Thus, during installation, notch 180 may assist a worker securing door 130 to hinge assembly 140. As may be seen in FIG. 4, inset 188 of foot 167 is also placed adjacent ledge 174 of door 130.

As shown in FIG. 5, in order to secure foot 167 to door 130, foot 167 is positioned within pocket 170 (FIG. 4) of door 130. Thus, substantially planar portion 168 (FIG. 4) of foot 167 is positioned within pocket 170. At least a portion of a top surface 184 (FIG. 3) and a bottom surface 186 (FIG. 3) of tip 169 are positioned adjacent door 130 in cavity 173 (FIG. 4) such that at least a portion of tip 169 is disposed within cavity 173. Also, a fastener 190 extends though foot 167, door 130, and a nut 192. Nut 192 is disposed within slot 167 (FIG. 4) of door 130. Fastener 190 assists in selectively securing foot 167 to door 130.

In order to place foot 167 in pocket 160 as shown in FIGS. 4 and 5, a worker may slide tip 169 into cavity 173 until substantially planar portion 168 impacts ledge 174. The worker may increase pressure on foot 167 until studs 175 of ledge 174 deform and ledge 174 is received into inset 188. Similarly, because hinge assembly 140 may be constructed using casting methods, sidewalls 182 of foot 167 may have a draft such that sidewalls 182 and substantially planar portion 168 are not perpendicular. Accordingly, when worker increases pressure, door 130 may also deform to receive draft of sidewalls 182. By deforming to receive inset 188 and draft of sidewalls 182, inset 188 and sidewalls 182 may assist fastener in securing foot 167 to door 130, e.g., by applying compressive force to foot 167. Worker may also insert fastener 190 through foot 167, door 130, and nut 192 to assist in securing foot 167 to door 130.

Figure 6:
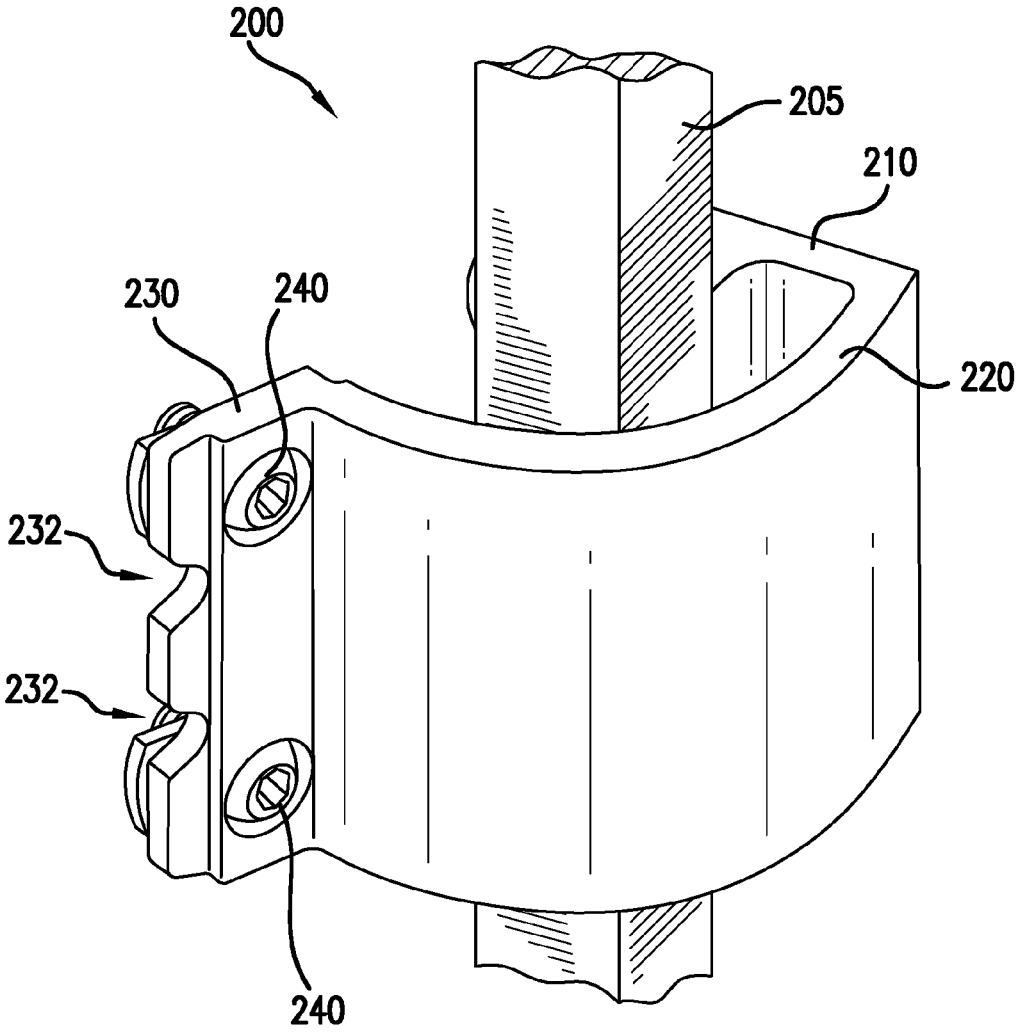
FIG. 6 provides a perspective view of a hinge assembly according to an exemplary embodiment of the present subject matter and as could be used in the washing machine appliance of FIG. 1.

FIG. 6 provides an additional hinge assembly 200 embodiment. Hinge assembly 200 may, e.g., be used in washing machine appliance 100 of FIG. 1 to mount door 130 to cabinet 102. Alternatively, hinge assembly 200 may be utilized when a single hinge arm rather than dual hinge arms are needed to secure a door to a cabinet. For example, in washing machine appliances with round rather than square doors, a single hinge arm 202 is needed to secure a door to a cabinet. Thus, hinge assembly 200 may be used when door 130 has a round profile rather than the square profile shown in FIG. 1.

Hinge assembly 200 includes an elongated member 205, an extension portion 210, an arcuate portion 220, and a foot 230 similar to hinge assembly 140 described above. Foot 230 includes a pair of notches 232 like notch 180 (shown in FIG. 2). A pair of fasteners 240 is also configured for securing hinge assembly 200 to a door (e.g., door 130 of FIG. 1).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance comprising:

a cabinet having a front panel;

a drum rotatably mounted within said cabinet, said drum defining a chamber for receipt of articles;

a door configured for permitting selective access to the chamber of said drum, said door defining a pocket, said door also defining a cavity positioned adjacent the pocket of said door, said door also having a ledge positioned adjacent the pocket of said door opposite the cavity;

a hinge assembly rotatably mounting said door to the front panel of said cabinet, said hinge assembly configured for rotation about an axis, said hinge assembly comprising:

an extension portion extending between a first end and a second end, the first end of said extension portion positioned adjacent the axis;

an arcuate portion having a proximal end and a distal end, the proximal end of said arcuate portion positioned adjacent the second end of said extension portion; and a foot positioned adjacent the distal end of said arcuate portion, said foot having a substantially planar segment extending between said arcuate portion and a tip of said foot, the tip of said foot disposed at least partially within the cavity of said door, the substantially planar segment of said foot positioned adjacent the pocket of said door such that the substantially planar segment of said foot extends between the cavity of said door and the ledge of said door, said foot also compressed against the ledge of said door adjacent the distal end of said arcuate portion; and a fastener configured for selectively securing said door to said hinge.

2. The appliance of claim 1, wherein the tip of said foot defines a notch configured for receiving a portion of the door of the appliance in order to impede vertical translation of said door.

3. The appliance of claim 1, wherein said foot has a draft such that sidewalls of said foot and the substantially planar segment are not perpendicular.

4. The appliance of claim 3, wherein said door deforms when said foot is disposed in the pocket.

5. The appliance of claim 1, wherein said fastener extends through said foot into said door in order to selectively secure said door to said hinge.

6. The appliance of claim 1, further comprising a nut received into a slot defined by said door, said fastener extending through said foot and said nut such that said fastener and said nut cooperate to selectively secure said door to said hinge.

7. The appliance of claim 1, wherein a top surface of the tip of said foot and a bottom surface of the tip of said foot are positioned immediately adjacent said door.

8. The appliance of claim 7, further comprising an elongated member extending between said hinge assembly and said additional hinge assembly, said elongated member connecting said hinge assembly and said additional hinge assembly together such that said hinge assembly and said additional hinge assembly rotate in unison about the axis.

9. The appliance of claim 1, further comprising:

an additional hinge assembly longitudinally spaced apart from said hinge assembly, said additional hinge assembly also rotatably mounting said door to the front panel of said cabinet, said additional hinge assembly also configured for rotation about the axis, wherein:

said door defines an additional pocket and an additional cavity positioned adjacent the additional pocket of said door, a tip of a foot of the additional hinge assembly being disposed at least partially within the additional cavity of said door, a substantially planar segment of the foot of said additional hinge assembly being positioned adjacent the additional pocket of said door.

10. The appliance of claim 1, wherein the appliance is a dryer appliance.

11. The appliance of claim 1, wherein the appliance is a washing machine appliance.

12. The appliance of claim 1, wherein the ledge of said door comprises a plurality of studs.

13. The appliance of claim 1, wherein the plurality of studs is configured to deform when said foot is compressed against the ledge of said door.

14. The appliance of claim 1, wherein said fastener extends through the substantially planar segment of said foot into said door.

15. The appliance of claim 14, wherein said fastener extends through the substantially planar segment of said foot and said door into a nut, the nut positioned opposite the substantially planar segment of said foot on said door.

16. An appliance comprising:

a cabinet having a front panel;

a drum rotatably mounted within said cabinet, said drum defining a chamber for receipt of articles;

a door configured for permitting selective access to the chamber of said drum, said door defining a pair of pockets, said door also defining a pair of cavities, each of said pair of cavities positioned adjacent a respective one of the pair of pockets, said door also having a pair of ledges, each ledge of the pair of ledges positioned adjacent the respective one of the pair of pockets opposite a respective one of the pair of cavities;

a pair of hinges rotatably mounting said door to the front panel of said cabinet, said pair of hinges configured for rotation about an axis, each of said pair of hinges comprising:

an extension portion extending between a first end and a second end, the first end of said extension portion positioned adjacent the axis;

an arcuate portion having a proximal end and a distal end, the proximal end of said arcuate portion positioned adjacent the second end of said extension portion; and a foot positioned adjacent the distal end of said arcuate portion, said foot having a substantially planar segment extending between said arcuate portion and a tip of said foot, the tip of said foot disposed at least partially within a respective one of the pair of cavities of said door, the substantially planar segment of said foot positioned adjacent a respective one of the pockets of said door such that the substantially planar segment of said foot extends between the respective one of the pair of cavities of said door and a respective ledge of the pair of ledges of said door, said foot also compressed against the respective ledge of the pair of ledges of said door adjacent the distal end of said arcuate portion; and a pair of fasteners configured for cooperating with said pair of hinges in order to selectively secure said door to said hinge.

17. The appliance of claim 16, further comprising an elongated member extending between said pair of hinges, said elongated member connecting said pair of hinges together such that said pair of hinges rotate in unison about the axis.

* * * * *